US006511952B1

(12) United States Patent
Schwartz

(10) Patent No.: US 6,511,952 B1
(45) Date of Patent: Jan. 28, 2003

(54) USE OF 2-METHYL-1, 3-PROPANEDIOL AND POLYCARBOXYLATE BUILDERS IN LAUNDRY DETERGENTS

(75) Inventor: Steven A. Schwartz, Downington, PA (US)

(73) Assignee: ARCO Chemical Technology, L.P., Greenville, DE (US)

( * ) Notice: Subject to any disclaimer, the term of this patent is extended or adjusted under 35 U.S.C. 154(b) by 74 days.

(21) Appl. No.: 09/602,188

(22) Filed: Jun. 12, 2000

(51) Int. Cl.[7] ..... C11D 3/37; C11D 3/20; C11D 3/43

(52) U.S. Cl. ..... 510/361; 510/342; 510/434; 510/446; 510/478; 510/479; 510/533

(58) Field of Search ..... 510/342, 361, 510/434, 446, 478, 479, 533

(56) References Cited

U.S. PATENT DOCUMENTS

| | | | | |
|---|---|---|---|---|
| 3,719,647 A | | 3/1973 | Hardy et al. | |
| 4,521,332 A | | 6/1985 | Milora | |
| 4,663,071 A | | 5/1987 | Bush et al. | |
| 4,746,456 A | | 5/1988 | Kud et al. | |
| 4,946,627 A | | 8/1990 | Leighton et al. | |
| 5,004,557 A | | 4/1991 | Nagarajan et al. | |
| 5,049,302 A | | 9/1991 | Holland et al. | |
| 5,308,530 A | | 5/1994 | Aronson et al. | |
| 5,376,300 A | | 12/1994 | Bolkan et al. | |
| 5,536,440 A | | 7/1996 | Gopalkrishnan et al. | |
| 5,565,145 A | | 10/1996 | Watson et al. | |
| 5,574,004 A | | 11/1996 | Carr | |
| 5,595,681 A | | 1/1997 | Panandiker et al. | |
| 5,614,017 A | | 3/1997 | Shawl | |
| 5,739,099 A | * | 4/1998 | Welch et al. | 510/514 |
| 5,858,951 A | | 1/1999 | Ip et al. | |
| 5,952,432 A | * | 9/1999 | Yamaguchi et al. | 525/404 |
| 5,977,047 A | | 11/1999 | Carr | |
| 6,034,045 A | | 3/2000 | Carr et al. | |
| 6,034,208 A | | 3/2000 | McDaniel et al. | |
| 6,075,993 A | | 6/2000 | Kawamoto | |

FOREIGN PATENT DOCUMENTS

| | | | |
|---|---|---|---|
| EP | 0 219 048 A2 | | 10/1986 |
| EP | 0 358 472 B1 | | 12/1994 |
| EP | 0 995 791 A1 | | 4/2000 |
| EP | 995791 | * | 4/2000 |
| WO | WO 99/06520 | | 2/1999 |
| WO | WO 99/36496 | | 7/1999 |

* cited by examiner

*Primary Examiner*—Yogendra N. Gupta
*Assistant Examiner*—Brian P. Mruk
(74) *Attorney, Agent, or Firm*—Brooks & Kushman P.C.

(57) ABSTRACT

A liquid laundry detergent formulation is described including a surfactant, a polycarboxylate builder and a 2-methyl-1,3-propanediol carrier solvent. A particularly preferred builder comprises a non-hydrophobically modified, acrylic/polyether comb-branched copolymer, wherein the polyether portion comprises moieties derived from at least two constituents selected from the group consisting of ethylene oxide, propylene oxide, and butylene oxide. Preferably, the comb-branched copolymer is made according to a process selected from the group consisting of: (i) copolymerizing an unsaturated macromonomer with at least one ethylenically unsaturated comonomer selected from the group consisting of carboxylic acids, carboxylic acid salts, hydroxyalkyl esters of carboxylic acids, and carboxylic acid anhydrides, and (ii) reacting a carboxylic acid polymer and a polyether prepared by polymerizing a $C_2$–$C_4$ epoxide, wherein the carboxylic acid polymer and the polyether are reacted under conditions effective to achieve partial cleavage of the polyether and esterification of the polyether and cleavage products thereof by the carboxylic acid polymer.

21 Claims, No Drawings

USE OF 2-METHYL-1, 3-PROPANEDIOL AND POLYCARBOXYLATE BUILDERS IN LAUNDRY DETERGENTS

TECHNICAL FIELD

The present invention pertains to stable liquid laundry detergent formulations comprising polycarboxylate builders.

BACKGROUND ART

The use of builders to improve the overall detergency effectiveness and the whitening power of liquid laundry detergent formulations is well known. Typically, builders have been used, among other things, as sequestering agents to remove metallic ions such as calcium or magnesium (or the "hardness") from the washing fluid, to provide solubilization of water insoluble materials, to promote soil suspension, to retard soil redeposition and to provide alkalinity. Examples of liquid laundry detergent formulations are described in U.S. Pat. Nos. 6,034,045, 5,858,951, 5,575,004, 5,308,530, 4,663,071 and 3,719,647.

Polyphosphate compounds, such as tripolyphosphates and pyrophosphates, have been widely used as builders in detergent compositions, in part because of their ability in sequestering hardness ions. While the use of such phosphate compounds has been very effective, environmental concerns have mounted regarding their possible contribution to the growth of algae in lakes and streams and the resulting eutrophication of such bodies of water. This concern has caused significant legislative pressure to lower or discontinue use of phosphates in detergent compositions to control pollution.

Detergent manufacturers have looked to polycarboxylate polymers and copolymers as potential effective, non-phosphate detergent builders. For instance, U.S. Pat. Nos. 5,308,530, 4,663,071 and 3,719,647 disclose polycarboxylate builders for use with suitable surfactants in laundry detergent formulations. In U.S. Pat. No. 3,719,647, the polycarboxylate builder comprises a copolymer of a polyether and carboxylic acid, wherein the polyether component is made up of ethylene oxide units.

Often, a polycarboxylate may be unsuited for use as a liquid laundry detergent formulation builder, even when having excellent detergency effectiveness and whitening power. This is because the polycarboxylate is not readily compatible with anionic and non-ionic surfactants, i.e., does not exhibit acceptable phase stability. If a polymer is not readily compatible with these surfactants, phase separation in the liquid laundry detergent may result, thus requiring the addition of expensive hydrotropes for stabilization.

Accordingly, there is a need to identify liquid laundry detergent formulations comprising polycarboxylate builders that do not require the use of hydrotropes to be stable in liquid laundry detergents.

DISCLOSURE OF INVENTION

It has now been surprisingly discovered that liquid laundry detergent formulations comprising polycarboxylate builders and a certain dihydric glycol carrier solvent have an extremely broad range of phase stability. The dihydric glycol carrier solvent comprises 2-methyl-1,3-propanediol, sold as MPDiol® glycol by Lyondell Chemical Company.

It has also been surprisingly discovered that certain non-hydrophobically modified, acrylic/polyether comb-branched copolymers, wherein the polyether units contain moieties derived from at least two constituents selected from the group consisting of ethylene oxide, propylene oxide, and butylene oxide, are useful as builders, even without any 2-methyl-1,3-propanediol in laundry detergent formulations.

The non-hydrophobically modified, acrylic/polyether comb-branched polymers of the present invention exhibit surprisingly good anti-redeposition and stability properties when used in liquid laundry detergent formulations. Furthermore, it has also been surprisingly discovered that the non-hydrophobically modified, acrylic/polyether comb-branched copolymers of the present invention exhibit surprisingly good anti-redeposition and anti-encrustation properties when used in a solid laundry detergent formulation.

DESCRIPTION OF THE PREFERRED EMBODIMENTS

Minimally, liquid laundry detergent formulations made in accordance with the present invention comprise a surfactant (surface active agent), a polycarboxylate builder, water, and 2-methyl-1,3-propanediol solvent. Additionally, the liquid laundry detergent formulations of the present invention may also comprise ion exchangers, alkalis, anti-corrosion materials, anti-redeposition materials, optical brighteners, fragrances, dyes, fillers, chelating agents, enzymes, fabric whiteners and brighteners, sudsing control agents, bleaching agents, bleach precursors, buffering agents, soil removing agents, soil release agents, fabric softening agents, and opacifiers. Examples of liquid laundry detergent formulations and the manner in which they are made are described in U.S. Pat. Nos. 6,034,045, 5,858,951, 5,575,004, 5,308,530, 4,663,071 and 3,719,647, which are incorporated herein by reference.

The 2-methyl-1,3-propanediol is present in the liquid laundry detergent formulation in an amount effective to increase the phase stability of the liquid laundry detergent formulation relative to liquid laundry detergent formulations not containing the effective amount of the 2-methyl-1,3-propanediol. Preferably, the liquid laundry detergent formulations of the present invention comprise between about 0.1 to about 60 weight percent of a surfactant, about 0.1 to about 70 weight percent of a polycarboxylate builder, about 0.1 to 50 weight percent 2-methyl-1,3-propanediol and about 50 to about 99 weight percent water. More preferably, the liquid laundry detergent formulations of the present invention comprise between about 0.5 to about 30 weight percent of a surfactant, about 0.1 to about 40 weight percent of a polycarboxylate builder, about 0.1 to 40 weight percent 2-methyl-1,3-propanediol, and about 50 to about 99 weight percent water. Most preferably, the liquid laundry detergent formulations of the present invention comprise between about 5 to about 20 weight percent of a surfactant, about 0.1 to about 30 weight percent of a polycarboxylate builder, about 0.1 to 20 weight percent 2-methyl-1,3-propanediol, and about 50 to about 99 weight percent water. In each formulation, the sum of all weight percentages totals 100%, including, of course, the weight percentages of the aforementioned additional ingredients.

The 2-methyl-1,3-propanediol functions as carrier solvent or as a surfactant compatabilizer. 2-Methyl-1,3-propanediol is available commercially as MPDiol® glycol from Lyondell Chemical Company. In addition to the 2-methyl-1,3-propanediol, other carrier solvents may be used. Suitable examples of other carrier solvents include methanol, ethanol, propanol, isopropanol, 1,3-propanediol, ethylene glycol, glycerine, and 1,2-propanediol (propylene glycol).

The chemical nature of the surfactants, as well as the various optional components used in detergent compositions, are well known to those skilled in the art. Typical disclosures of these materials may be found in U.S. Pat. No. 4,663,071, which is incorporated herein by reference. It should be understood that the surfactant portion of the liquid laundry detergent formulation may comprise one surfactant or a blend of surfactants. The surfactants may include nonionic surfactants, anionic surfactants, cationic surfactants, and amphoteric surfactants.

Any suitable polycarboxylate builder can be used. The polycarboxylate builder component can comprise one polycarboxylate builder, a mixture of polycarboxylate builders, or a mixture of one or more polycarboxylate builders with one or more non-polycarboxylate builders. Suitable polycarboxylate and non-polycarboxylate builders are well known in the art and can be found in various literature sources, such as U.S. Pat. Nos. 4,663,071, 5,308,530, 3,719,647, and 5,574,004, which are incorporated herein by reference.

A preferred polycarboxylate builder comprises a non-hydrophobically modified, acrylic/polyether comb-branched copolymer wherein the polyether portion comprises moieties derived from at least two constituents selected from the group consisting of ethylene oxide, propylene oxide and butylene oxide. By non-hydrophobically modified, it is meant that the polyether chain does not bear any hydrophobic end caps, i.e. a hydrocarbon having more than four carbon atoms, such as 2-ethylhexyl, lauryl, nonylphenyl, and the like. It should be noted that the preferred non-hydrophobically modified, acrylic/polyether comb-branched copolymer of the present invention is suitable for use as a builder or cobuilder in both liquid laundry detergent formulations and solid laundry detergent formulations such as powder laundry detergent formulations and tablet laundry detergent formulations. When used in liquid laundry detergent formulations, the preferred non-hydrophobically modified acrylic/polyether comb-branched copolymer of the present invention exhibits acceptable results even when used without any 2-methyl-1,3-propanediol.

The non-hydrophobically modified, acrylic/polyether comb-branched copolymer preferably has a molecular weight of 400 grams per mole to about 500,000 grams per mole, more preferably between about 600 grams per mole to about 400,000 grams per mole, and most preferably between about 1,000 grams per mole to about 100,000 grams per mole. The copolymer preferably has a mole ratio of acrylic monomer units to polyether units of about 1/99 to about 99/1, more preferably from about 1/1 to about 20/1, and most preferably from about 4/1 to about 20/1.

The comb-branched copolymer can be made by any suitable process for copolymerizing acrylic units with polyether units, as long as the resulting copolymer is non-hydrophobically modified and comprises polyether units containing moieties derived from at least two constituents selected from the group consisting of ethylene oxide, propylene oxide and butylene oxide. Preferably, the copolymer is formed by reacting a polyether polymer or macromonomer with an acrylic monomer or polyacrylic acid polymer. The process may be continuous, batch, or semi-batch. Following the copolymerization process, any relatively volatile unreacted monomers are generally stripped from the product.

More preferably, the comb-branched copolymer is made according to a process selected from the group consisting of (i) copolymerizing an unsaturated macromonomer with at least one ethylenically unsaturated comonomer selected from the group consisting of carboxylic acids, carboxylic acid salts, hydroxyalkyl esters of carboxylic acids, and carboxylic acid anhydrides, and (ii) reacting a carboxylic acid polymer and a polyether prepared by polymerizing a $C_2$–$C_4$ epoxide, wherein the carboxylic acid polymer and the polyether are reacted under conditions effective to achieve partial cleavage of the polyether and esterification of the polyether and cleavage products thereof by the carboxylic acid polymer.

The preferred polyether polymer or macromonomer preferably comprises ethylene oxide and propylene oxide and has a molecular weight of about 300 grams per mole to about 100,000 grams per mole, more preferably between about 500 grams per mole to about 75,000 grams per mole, and most preferably between about 1,000 grams per mole to about 10,000 grams per mole. All molecular weights are number average molecular weights unless stated otherwise. Preferably, the ratio of propylene oxide (PO) to ethylene oxide (EO) of the polyether polymer or polyether macromonomer is preferably between about 99/1 to about 1/99, more preferably between about 80/20 to about 1/99, and most preferably between about 60/40 to about 1/99 by weight.

A preferred process for making the copolymer comprises: (a) forming a monomer stream, an initiator stream, and an optional chain transfer agent stream; (b) polymerizing the. streams in a reaction zone at a temperature within the range of about −20° C. to about 150° C.; and (c) withdrawing a polymer stream from the reaction zone. This process is described in more detail in copending U.S. patent application Ser. No. 09/358,009, filed Jul. 21, 1999, which is incorporated herein by reference.

The monomer stream contains an acrylic monomer and a polyether macromonomer. Suitable acrylic monomers are derived from acrylic acid and methacrylic acid. Preferred acrylic monomers include acrylic acid, methacrylic acid, their ammonium and alkali metal salts, their $C_1$ to $C_{10}$ alkyl and $C_6$ to $C_{12}$ aryl esters, and their amides. Acrylic acid, methacrylic acid, ammonium acrylate, ammonium methacrylate, sodium acrylate, sodium methacrylate, potassium acrylate, and potassium methacrylate are preferred. Most preferred are acrylic acid and methacrylic acid.

Suitable polyether macromonomers have a polyether chain and a single carbon-carbon double bond, which can be located either terminally or within the polyether chain. Examples include polyether monoacrylates, polyether monomethacrylates, polyether monoallyl ethers, polyether monomaleates, and polyether monofumarates. Further examples include the reaction product of a hydroxyl-functional polyether with isocyanatoalkyl(meth)acrylates such as isocyanatoethylacrylate, and with ethylenically unsaturated aryl isocyanates such as TMI. The polyether of the macromonomer is an alkylene oxide polymer having a number average molecular weight within the range of about 500 to about 10,000. Suitable alkylene oxides include ethylene oxide, propylene oxide, butylene oxide, and the like, and mixtures thereof. The polyether macromonomers preferably have hydroxyl functionality from 0 to 5. They can be either linear or branched polymers, homopolymers or copolymers, random or block copolymers, diblock or multiple-block copolymers.

Examples of polyether macromonomers are poly (propylene glycol) acrylates or methacrylates, poly(ethylene glycol) acrylates or methacrylates, poly(ethylene glycol) methyl ether acrylates or methacrylates, acrylates or methacrylates of an oxyethylene and oxypropylene block or random copolymer, poly(propylene glycol) allyl ether, poly (ethylene glycol) allyl ether, poly(propylene glycol) monomaleate, and the like, and mixtures thereof. Preferred polyether macromonomers are poly(propylene glycol) acrylates or methacrylates, poly(ethylene glycol) acrylates or methacrylates, acrylates or methacrylates of an oxyethylene and oxypropylene block and/or random copolymer. More preferred are acrylates or methacrylates of an oxyethylene and oxypropylene block and/or random copolymer.

The ratio of acrylic monomer to polyether macromonomer is determined by many factors within the skilled person's discretion, including the required physical properties of the comb-branched copolymer, the selection of the acrylic monomer, and the properties of the polyether macromonomer. The ratio generally is within the range from 1/99 to 99/1 by weight. The preferred range is from 5/95 to 75/25.

In one embodiment, t he macromonomer is made by (a) oxyalkylating an initiator molecule selected from the group consisting of hydroxyalkyl acrylates, hydroxyalkyl methacrylates, and monounsaturated monocarboxylic acids with an alkylene oxide in the presence of an effective amount of a double metal cyanide complex catalyst under conditions effective to form a well-defined unsaturated macromonomer having a terminal hydroxyl functionality and not more than substantially one initiator molecule per unsaturated macromonomer molecule. This method is described in substantial detail in U.S. Pat. No. 6,034,208, which is incorporated herein by reference. Also, the macromonomer described in U.S. Pat. No.6,034,208 in addition to being reacted in the manner described in the preferred continuous process described herein, can be reacted with the comonomer in the manner described in U.S. Pat. No. 6,034,208.

Optionally, the monomer stream contains a third monomer. The third monomer is preferably selected from vinyl aromatics, vinyl halides, vinyl ethers, vinyl esters, vinyl pyrrolidinones, onjugated dienes, unsaturated sulfonic acids, unsaturated phosphonic acids, and the like, and mixtures thereof. The amount of third monomer used depends on the required physical properties of the comb-branched copolymer product, but is preferably less than 50% by weight of the total amount of monomers.

Optionally, the monomer stream also includes a solvent. The solvent is used to dissolve the monomer, to assist heat transfer of the polymerization, or to reduce the viscosity of the final product. The solvent is preferably selected from water, alcohols, ethers, esters, ketones, aliphatic hydrocarbons, aromatic hydrocarbons, halides, and the like, and mixtures thereof. Selections of solvent type and amount are determined by the polymerization conditions including reaction temperature. Water and alcohols, such as methanol, ethanol, and isopropanol are preferred.

The initiator stream contains a free radial initiator. The initiator is preferably selected from persulfates, hydrogen peroxide, organic peroxides and hydroperoxides, azo compounds, and redox initiators such as hydrogen peroxide plus ferrous ion. Persulfates, such as ammonium and potassium persulfate, are preferred.

Optionally, the initiator stream contains a solvent. The solvent is used to dissolve or dilute the initiator, to control the polymerization rate, or to aid heat or mass transfer of the polymerization. Selections of solvent type and amount are determined by the nature of the initiator and the polymerization conditions. Water and alcohols such as methanol, ethanol, and isopropanol are preferred when persulfate is used as the initiator.

The monomer and initiator streams optionally include a chain transfer agent. Suitable chain transfer agents include alkyliodides and bromides, branched lower alcohols such as isopropanol, alkyl amines, alkyl sulfides, alkyl disulfides, carbon tetrahalides, allyl ethers, and mercaptans. Mercaptans, such as dodecyl mercaptan, butyl mercaptan, mercaptoacetic and mercaptopropionic acids, are preferred.

Under some conditions, it is preferred to add the chain transfer agent in a separate stream. This is particularly desirable when the chain transfer agent causes decomposition of the initiator or polymerization of the monomer once it is mixed with those components. This is particularly important in a large, commercial scale because these reactions can cause safety problems.

Optionally, the chain transfer agent stream contains a solvent that is used to dissolve or dilute the chain transfer agent. Suitable solvents include water, alcohols, ethers, esters, ketones, aliphatic and aromatic hydrocarbons, halides, and the like, and mixtures thereof. Selections of solvent type and amount are determined by the nature of the chain transfer agent and the polymerization conditions. Water and alcohols, such as methanol, ethanol, and isopropanol, are preferred.

The monomer stream, initiator stream, and optional chain transfer agent stream are polymerized in a reaction zone. The reaction temperature is preferably kept essentially constant during the polymerization. The temperature is determined by a combination of factors including the desired molecular weight of the comb-branched polymer product, the initiator type and concentration, the monomer type and concentration, and the solvent used. The reaction is performed at a temperature within the range of about −20° C. to about 150° C., preferably, within the range of about 20° C. to about 90° C. Most preferred is the range of about 40° C. to about 60° C.

The addition rate of each stream depends on the desired concentration of each component, the size and shape of the reaction zone, the reaction temperature, and many other considerations. In general, the streams flow into the reaction zone at rates that keep the initiator concentration within the range of about 0.01% to about 1% by weight, and the chain transfer agent concentration within the range of about 0.1% to about 1.5% by weight.

The reaction zone is where the polymerization takes place. It can be in the form of a tank reactor, a tubular reactor, or any other desirably shaped reactor. The reaction zone is preferably equipped with a mixer, a heat transfer device, an inert gas source, and any other suitable equipment.

As the streams are polymerized in the reaction zone, a polymer stream is withdrawn. The flow rate of the polymer stream is such that the reaction zone is mass-balanced, meaning that the amount of material that flows into the reaction zone equals to the amount of material withdrawn from the reaction zone. The polymer stream is then collected.

The comb-branched copolymer may also be made according to a multiple-zone process. A multiple-zone process is similar to the process discussed above except that more than one reaction zone is used. In a multiple-zone process, a first polymer stream is withdrawn from a first reaction zone and transferred into a second reaction zone where the polymerization continues. A second polymer stream is withdrawn from the second reaction zone. More than two reaction zones can be used if desirable. The reaction temperature in the second reaction zone can be the same as or different from the first reaction zone. A multiple-zone process can enhance monomer conversion and increase efficiency of the process. Usually, in the first polymer stream, the monomer conversion is within the range of about 65% to 85% by weight. The second reaction zone preferably brings the monomer conversion to 90% or greater.

In a second preferred process, the comb-branched copolymer of the present invention for use with the laundry detergent formulations can be made by reacting (a) a carboxylic acid polymer prepared by polymerizing a polymerizable acid monomer containing at least one ethylenically unsaturated group in conjugation with a carboxyl group selected from the group consisting of carboxylic acid, carboxylic anhydride and carboxylic ester groups, and (b) a polyether prepared by polymerizing a $C_2$–$C_4$ epoxide, wherein (a) and (b) are reacted under conditions effective to achieve partial cleavage of the polyether and esterification of the polyether and cleavage products thereof by the carboxylic acid polymer. This method is described in substantial detail in U.S. Pat. No. 5,614,017, which is incorporated herein by reference.

The following examples merely illustrate the present invention. Those skilled in the art will recognize many variations that are within the spirit of the invention and scope of the claims.

EXAMPLE 1

Preparation of Comb-Branched Copolymer By Continuous Process

An acrylate of oxyethylene/oxypropylene random copolymer having oxyethylene/oxypropylene ratio 50/50 by weight and number average molecular weight $M_n$ of 2,000 (122.5 g, 0.0613 mole), acrylic acid (17.6 g, 0.245 mole), mercaptopropionic acid (1.2 g) and ammonium persulfate (0.70 g) are charged into a one-liter reactor. The reactor is equipped with a stirrer, a temperature controller, a heating coil, a nitrogen purge device, a monomer addition pump, an initiator addition pump, and a sample outlet. The reactor contents are purged with $N_2$ for 20 minutes. Polyether macromonomer (245 g, 0.123 mole), acrylic acid (35.4 g, 0.492 mole), mercaptopropionic acid (2.6 g) and deionized water (DI water) (145 g) are mixed. The mixture is purged with $N_2$ for 20 minutes and the charged into the monomer pump. Ammonium persulfate (1.4 g) is dissolved in DI water (153 g). The solution is purged with $N_2$ for 20 minutes and then charged into the initiator pump. The reactor contents are heated to 40° C. The monomer mixture and the initiator solution are continuously pumped into the reactor at the rates of 1.0 gram/min and 0.33 gram/min, respectively. The product is continuously withdrawn from the reactor rate of 1.33 gram/min. It has a number average molecular weight $M_n$: 10820, and molecular weight distribution $M_w/M_n$: 1.36.

EXAMPLE 2

Phase Stability of Liquid Laundry Detergent Formulations

The phase stability of the copolymer of Example 1 along with a commercially known copolymer, Sokalan® HP22G, from BASF are tested. Visual determinations of the phase boundaries (transition between homogeneous solution and phase-separated mixture) as a function of composition are made following six consecutive freeze/thaw cycles. The freeze temperature is −50° F. (−45° C.) and the thaw condition is room temperature. The duration for each cycle is 48 hours (24 hours at low temperature and 24 hours at high temperature).

Various mixtures are evaluated at varying weight fractions of the water portion, the surfactant portion, and the polymer portion. Four formulations are studied and are summarized below. (X indicates that the ingredient is included in formulation.)

| | Water Portion Ingredients | | | | | Surfactant Portion Ingredients | | | Polymer Portion Ingredients | | |
|---|---|---|---|---|---|---|---|---|---|---|---|
| | DI $H_2O$ | Na Citrate | Na Borate | MPD[1] | PG | DI $H_2O$ | LAS[2] | Non-ionic[3] | DI $H_2O$ | LYO[4] | HP22G[5] |
| Formulation 1 | X | X | X | X | | X | X | X | X | X | |
| Formulation 2 | X | X | X | | X | X | X | X | X | X | |
| Formulation 3 | X | X | X | X | | X | X | X | X | | X |
| Formulation 4 | X | X | X | | X | X | X | X | X | | X |

[1]MPDiol ® Glycol from Lyondell
[2]Na dodecylbenzene sulfonate
[3]Shell Neodol ® 23-6.5
[4]Comb-branched Copolymer of Example 1
[5]BASF Sokalan ® HP22G The water portions for formulations 1–4 are prepared by making an aqueous solution mixture of 6 parts sodium citrate, 2.5 parts sodium borate, 5 parts dihydric glycol, and 86.5 parts water. Unless expressly stated, parts, as used herein, refers to "dry" parts, i.e. the active amount or amount solids of a component. The borate and citrate are first dissolved into the water, with the dihydric glycol then being added. For formulations 1 and 3, the dihydric glycol comprises MPDiol® glycol (2-methyl-1,3-propanediol), from the Lyondell Chemical Company. For formulations 2 and 4, the dihydric glycol comprises propylene glycol (1,2-propanediol).

The surfactant portion for formulations 1–4 is prepared by making an aqueous mixture of 25 parts linear sodium dodecylbenzene (LAS) and 14 parts non-ionic alcohol ethoxylate surfactant. The LAS is first dissolved in the water, with the non-ionic alcohol ethoxylate being added.

The polymer portion comprises copolymer dissolved in water. For formulations 1 and 2, the copolymer comprises the copolymer of Example 1. For formulations 3 and 4, the copolymer comprises BASF's Sokalan® HP22G.

The various mixtures and their results are shown below in Table 1. "S" indicates a stable formulation (i.e., homogeneous) and,"U" indicates an unstable formulation (i.e., phase separated). As can be seen from Table 1, when employing MPDiol® glycol as a carrier solvent with the copolymer of the present invention, as illustrated by Formulation 1, the range of stability dramatically increases over Formulation 2's range of stability, which is essentially identical to Formulation 1 except that it has a propylene glycol solvent carrier instead of MPDiol® glycol. Formulations 3 and 4 employ a different polymer, and do not display the differences in stability exhibited by Formulations 1 and 2. However, the examples together demonstrate that the use of conventional diols such as propylene glycol limits the scope of formulations when polyacrylate builders are used.

TABLE 1

| | | | | | | | | | | | | | | |
|---|---|---|---|---|---|---|---|---|---|---|---|---|---|---|
| Wt. % Surfactant (neat) | 7.5 | 10 | 12.5 | 17.5 | 2.5 | 5 | 7.5 | 10 | 12.5 | 14 | 2.5 | 5 | 7.5 | 9 |
| Wt. % Polymer (neat) | 12.5 | 10 | 7.5 | 2.5 | 12.5 | 10 | 7.5 | 5 | 2.5 | 1 | 7.5 | 5 | 2.5 | 1 |
| Wt. % Water Portion | 80 | 80 | 80 | 80 | 85 | 85 | 85 | 85 | 85 | 85 | 90 | 90 | 90 | 90 |
| Formulation 1 | S | S | S | S | S | S | S | S | S | S | S | S | S | S |
| Formulation 2 | U | U | U | U | S | S | S | S | U | U | S | S | U | U |
| Formulation 3 | S | S | S | U | S | S | S | S | U | U | S | U | U | U |
| Formulation 4 | S | S | S | U | S | S | S | S | U | U | S | U | U | U |

EXAMPLE 3

Anti-Rede position Propeties—Liquid Laundry Detergent

The anti-redeposition properties of the copolymer of Example 1 along with the same commercially known liquid laundry detergent copolymer Sokalan® HP22G of Example 2 are tested as they would be used in a liquid laundry detergent formulation.

Test method ASTM D 4008 is essentially followed to measure the relative ability of the two polymers to prevent soil deposition onto three types of elements. Rather than use soiled cloth to supply the soil for redeposition, the soil is added directly to the wash bath. The soils are the standard soiling media used to prepare soiled cloths; i.e., dust-sebum emulsion and clay slurry. The test requires multiple exposures to build up a measurable level of redeposited soil; so 10 sequential cycles are run.

A laboratory Terg-O-Tometer is used for the wash and rinse cycles. The water is placed in the pots and the detergent ingredients are added. After the dissolution time, the soils are added and allowed several seconds to disperse. A check is made to ensure that the detergent and soils are dispersed before adding the cloth swatches. The excess water is squeezed out by hand after the wash and rinse cycles. The swatches are dried in a clothes drier before the next cycle. The laundry conditions and the detergent ingredients are shown below.

| Laundry Conditions for Liquids | |
|---|---|
| Temperature | 95° F. |
| Water Hardness | 300 ppm Ca/Mg 2/1 |
| Detergent Concentration | 1 g/Liter |
| Terg-O-Tometer Speed | 100 cpm |
| Detergent Dissolve Time | 2 min. |
| Wash Time | 10 min. |
| Rinse Time | 5 min. |
| Cloth Load | 5 swatches each prewashed cotton #400, Cot. P.E.D.P.#7435WRL and Polyester #777 |

-continued

| Laundry Conditions for Liquids | |
|---|---|
| Soil Load | 3.09 g dust-sebum emulsion |
| | 1.81 g clay slurry |
| Number of Wash Cycles | 10 |

| Detergent Ingredients | |
|---|---|
| LAS,[1] Active basis | 16% |
| Non-ionic,[2] Active basis | 7% |
| Triethanolamine, Active basis | 10% |
| CMC,[3] Active basis | 2% |
| Polymer,[4] Active basis | 4% |

[1]LAS Vista C560 (60% solution in $H_2O$)
[2]Shell Neodol ® 25-7 (50% in PG)
[3]Carboxymethylcellulose (Penn Carbose)
[4]Copolymer of Example 1 or Sokalan ® HP22G Reflectances are measured on the clean cloths and after cycles 1, 5, and 10 of washing and drying. The "L" scale of a Gardner Colorgard System/05 reflectometer are used. Soil build-up on the fabrics is indicated by lower values of ΔL. Thus, −2.0 indicates a greater soil build-up on the fabrics than −1.5. The results are shown in Tables 2–4 below.

TABLE 2

Cumulative Soil Redeposition for Cotton Swatches

| No. of Cycles | Copolymer of Example 1 (Δ L) | Sokalan ® HP22G (Δ L) |
|---|---|---|
| 1 | −1.5 | −2.0 |
| 5 | −3.2 | −4.6 |
| 10 | −3.6 | −4.8 |

TABLE 3

Cumulative Soil Redeposition for Cotton/Polyester Swatches

| No. of Cycles | Copolymer of Example 1 (Δ L) | Sokalan ® HP22G (Δ L) |
|---|---|---|
| 1 | −3.8 | −3.1 |
| 5 | −6.2 | −5.4 |
| 10 | −6.2 | −5.4 |

TABLE 4

Cumulative Soil Redeposition for Polyester Swatches

| No. of Cycles | Copolymer of Example 1 (Δ L) | Sokalan ® HP22G (Δ L) |
|---|---|---|
| 1 | −6.8 | −2.8 |
| 5 | −7.5 | −5.5 |
| 10 | −7.1 | −4.8 |

As can be seen from the data, the preferred copolymer of the present invention provides comparable or better anti-redeposition properties than the commercially known Sokalan® HP22G.

EXAMPLE 4

Preparation of Comb-Branched Copolymer By Continuous Process

An acrylate of oxyethylene/oxypropylene random copolymer having oxyethylene/oxypropylene ratio 75/25 by weight and number average molecular weight Mn of 2,000 (122.5 g, 0.0613 mole) acrylic acid (88.3 g, 1.226 mole), mercaptopropionic acid (1.2 g) and ammonium persulfate (0.70 g) are charged into a one-liter reactor. The reactor is equipped with a stirrer, a temperature controller, a heating coil, a nitrogen purge device, a monomer addition pump, an initiator addition pump, and a sample outlet. The reactor content are purged with $N_2$ for 20 minutes. Polyether macromonomer (245 g, 0.123 mole), acrylic acid (177 g, 2.46 mole), mercaptopropionic acid (2.6 g) and distilled water (DI water)(145 g) are mixed. The mixture is purged with $N_2$ for 20 minutes and then charged to the monomer pump. Ammonium persulfate (1.4 g) is dissolved in DI water (153 g). The solution is purged with $N_2$ for 20 minutes and then charged into the initiator pump. The reactor contents are heated to 40° C. The monomer mixture and the initiator solution are continuously pumped into the reactor at the rates of 1.0 gram/min and 0.33 gram/min, respectively. The product is continuously withdrawn from the reactor at a rate of 1.33 gram/min.

EXAMPLE 5

Anti-Redeposition and Anti-Encrustation Properties—Powder Laundry Detergent

The anti-redeposition and anti-encrustation properties of the copolymer of Example 4 and the commercially known powder laundry detergent builder Acusol® 445N from Rohm and Haas are tested simultaneously.

The anti-redeposition properties are tested in the same manner as in Example 3, with the only difference being the builders and the ingredients added to the Terg-O-Tometer and the cloth load.

The ingredients are listed in the table below.

| Powder Detergent Ingredients | |
|---|---|
| LAS,[1] Active basis | 16% |
| Non-ionic,[2] Active basis | 7% |
| Na Carbonate, Active basis | 25% |
| Zeolite,[3] Active basis | 25% |

-continued

| Powder Detergent Ingredients | |
|---|---|
| CMC,[4] Active basis | 2% |
| Polymer,[5] Active basis | 2% |

[1]LAS Vista C560 (60% solution in $H_2O$)
[2]Shell Neodol ® 25-7 (50% in PG)
[3]Zeolite A PQ Valfor 100 from PQ Corp. of Conshohocken, PA
[4]Carboxymethylcellulose (Penn Carbose)
[5]Copolymer of Example or Acusol ® 445N Since anti-encrustation and anti-redeposition are tested simultaneously, the laundry load is twice that used in Example 3. Thus, 10 cotton swatches, 2 cotton/polyester, and 2 polyester swatches are used.

To measure anti-encrustation, after each wash and rinse cycle, the excess water is squeezed out of the laundry swatch and the swatches are dried to constant weight at 100° C. Limestone encrustation is determined as calcium carbonate weight percent. A triple extraction of the swatch with 25 ml of 0.2N HCL is used to get complete extraction of the calcium carbonate deposit on the swatches after 0, 1, 5, 10 cycles. An aliquot of the extract is titrated with EDTA and % calcium carbonate calculated.

The results are shown in Tables 5–8 below.

TABLE 5

Cumulative Soil Redeposition for Cotton Swatches

| No. of Cycles | Copolymer of Example 4 (Δ L) | Acusol ® 445N (Δ L) |
|---|---|---|
| 1 | −0.5 | −0.7 |
| 5 | −1.3 | −3.1 |
| 10 | −2.2 | −5.4 |

TABLE 6

Cumulative Soil Redeposition for Cotton/Polyether Swatches

| No. of Cycles | Copolymer of Example 4 (Δ L) | Acusol ® 445N (Δ L) |
|---|---|---|
| 1 | −0.5 | −0.1 |
| 5 | −1.6 | −1.5 |
| 10 | −2.4 | −2.9 |

TABLE 7

Cumulative Soil Redeposition for Polyester Swatches

| No. of Cycles | Copolymer of Example 4 (Δ L) | Acusol ® 445N (Δ L) |
|---|---|---|
| 1 | −0.5 | 0.1 |
| 5 | −1.3 | −1.0 |
| 10 | −2.1 | −2.4 |

TABLE 8

$CaCO_3$ Encrustation for Cotton Swatches

| No. of Cycles | Copolymer of Example 4 (Δ L) | Acusol ® 445N (Δ L) |
|---|---|---|
| 0 | 0.17 | 0.18 |
| 1 | 0.31 | 0.30 |
| 5 | 0.25 | 0.38 |
| 10 | 0.30 | 0.55 |

As can be seen from the above tables, the preferred copolymer of the present invention provides improved anti-redeposition and anti-encrustation properties, when used in a powder detergent formulation, than the commercially known Acusol® 445N.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A liquid laundry detergent formulation comprising:

a) water;

b) surfactant;

c) a polycarboxylate builder; and d) 2-methyl-1,3-propanediol.

2. The formulation of claim 1, wherein the 2-methyl-1,3-propanediol is present in an amount effective to increase the phase stability of the liquid laundry detergent formulation relative to the stability of a liquid laundry detergent formulation not containing the effective amount of the 2-methyl-1,3-propanediol.

3. The formulation of claim 1, wherein the 2-methyl-1,3-propanediol is present in an amount between about 0.1 to about 50 weight percent, based on the total weight of the formulation.

4. The formulation of claim 1, wherein the 2-methyl-1,3-propanediol is present in an amount between about 0.1 to about 40 weight percent, based on the total weight of the formulation.

5. The formulation of claim 1, wherein the 2-methyl-1,3-propanediol is present in an amount between about 0.1 to about 20 weight percent, based on the total weight of the formulation.

6. The formulation of claim 2 wherein the polycarboxylate builder comprises a non-hydrophobically modified, acrylic/polyether comb-branched copolymer, wherein the polyether portion comprises moieties derived from at least two constituents selected from the group consisting of ethylene oxide, propylene oxide and butylene oxide.

7. The formulation of claim 6, wherein the polycarboxylate builder is present in an amount of about 0.1 to about 70 weight percent, based on the total weight percent of the formulation.

8. The formulation of claim 7, wherein the comb-branched copolymer is made according to a process selected from the group consisting of:

a) copolymerizing an unsaturated macromonomer with at least one ethylenically unsaturated comonomer selected from the group consisting of carboxylic acids, carboxylic acid salts, hydroxyalkyl esters of carboxylic acids, and carboxylic acid anhydrides; and b) reacting a carboxylic acid polymer and a polyether prepared by polymerizing a $C_2$–$C_4$ epoxide, wherein the carboxylic acid polymer and the polyether are reacted under conditions effective to achieve partial cleavage of the polyether and esterification of the polyether and cleavage products thereof by the carboxylic acid polymer.

9. A laundry detergent formulation comprising:

a) a surfactant;

b) a non-hydrophobically modified, acrylic/polyether comb-branched copolymer, wherein the polyether portion comprises moieties derived from at least two constituents selected from the group consisting of ethylene oxide, propylene oxide and butylene oxide and c) 2-methyl-1,3-propanediol.

10. The formulation of claim 9 wherein the comb-branched copolymer is made according to a process selected from the group consisting of:

a) copolymerizing an unsaturated macromonomer with at least one ethylenically unsaturated comonomer selected from the group consisting of carboxylic acids, carboxylic acid salts, hydroxyalkyl esters of carboxylic acids, and carboxylic acid anhydrides; and b) reacting a carboxylic acid polymer and a polyether prepared by polymerizing a $C_2$–$C_4$ epoxide, wherein the carboxylic acid polymer and the polyether are reacted under conditions effective to achieve partial cleavage of the polyether and esterification of the polyether and cleavage products thereof by the carboxylic acid polymer.

11. The formulation of claim 10, wherein the detergent comprises a liquid laundry detergent that further comprises water.

12. The formulation of claim 10, wherein the detergent comprises a powder laundry detergent.

13. The formulation of claim 10, wherein the detergent comprises a tablet laundry detergent.

14. The formulation of claim 10, wherein the comb-branched copolymer is made according to the following method:

a) forming a monomer stream that contains an acrylic monomer and a polyether macromonomer, an initiator stream that contains a free radical initiator, and, optionally, a chain transfer agent stream;

b) polymerizing the streams in a reaction zone at a temperature within the range of about −20° C. to about 150° C.; and c) withdrawing a polymer stream from the reaction zone.

15. The formulation of claim 10, wherein the comb-branched copolymer is made according to the following method:

a) oxyalkylating an initiator molecule selected from the group consisting of hydroxyalkyl acrylates, hydroxyalkyl methacrylates, and monounsaturated monocarboxylic acids with an alkylene oxide in the presence of an effective amount of a double metal cyanide complex catalyst under conditions effective to form a well-defined unsaturated macromonomer having a terminal hydroxyl functionality and not more than substantially one initiator molecule per unsaturated macromonomer molecule; and b) copolymerizing the unsaturated macromonomer with at least one ethylenically unsaturated comonomer selected from the group consisting of carboxylic acids, carboxylic acid salts, hydroxyalkyl esters of carboxylic acids, and carboxylic acid anhydrides.

16. The formulation of claim 10, wherein the comb-branched copolymer is made by reacting:

a) a carboxylic acid polymer prepared by polymerizing a polymerizable acid monomer containing at least one ethylenically unsaturated group in conjugation with a carboxyl group selected from the group consisting of carboxylic acid, carboxylic anhydride and carboxylic ester groups; with b) a polyether prepared by polymerizing a $C_2$–$C_4$ epoxide, wherein a) and b) are reacted under conditions effective to achieve partial cleavage of the polyether and esterification of the polyether and cleavage products thereof by the carboxylic acid polymer.

17. The formulation of claim 9, wherein the formulation is free of any hydrotopes.

18. The formulation of claim 9, wherein the comb-branched copolymer has an average molecular weight (Mn) of about 400 grams per mole to about 500,000 grams per mole.

19. The formulation of claim 18, wherein the polyether comprises an acrylate oxyethylene/oxypropylene random copolymer.

20. The formulation of claim 9, wherein the copolymer consists essentially of acrylic and polyether moieties.

21. A laundry detergent formulation comprising:

a) a surfactant;

b) a non-hydrophobically modified, acrylate/polyether comb-branched copolymer; and c) 2-methyl-1,3-propanediol.

* * * * *